US011634969B2

(12) United States Patent
Stolboushkin et al.

(10) Patent No.: US 11,634,969 B2
(45) Date of Patent: Apr. 25, 2023

(54) MULTI-STAGE OBJECT DROP FRAC ASSEMBLY WITH FILTRATION MEDIA AND METHOD

(71) Applicants: Eugene Stolboushkin, Houston, TX (US); Todd Christopher Jackson, Houston, TX (US); Matthew D. Solfronk, Katy, TX (US); James Scott Sanchez, Spring, TX (US); Ricardo Arturo Gomez Barker, Houston, TX (US)

(72) Inventors: Eugene Stolboushkin, Houston, TX (US); Todd Christopher Jackson, Houston, TX (US); Matthew D. Solfronk, Katy, TX (US); James Scott Sanchez, Spring, TX (US); Ricardo Arturo Gomez Barker, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 50 days.

(21) Appl. No.: 17/199,730

(22) Filed: Mar. 12, 2021

(65) Prior Publication Data

US 2022/0290530 A1 Sep. 15, 2022

(51) Int. Cl.

| | |
|---|---|
| ***E21B 34/14*** | (2006.01) |
| ***E21B 43/10*** | (2006.01) |
| ***E21B 43/26*** | (2006.01) |
| ***E21B 23/00*** | (2006.01) |

(52) U.S. Cl.
CPC ..... *E21B 34/14* (2013.01); *E21B 23/004* (2013.01); *E21B 34/142* (2020.05); *E21B 43/10* (2013.01); *E21B 43/26* (2013.01)

(58) Field of Classification Search
CPC ..... E21B 34/14; E21B 43/10; E21B 23/004; E21B 34/142
See application file for complete search history.

(56) References Cited

U.S. PATENT DOCUMENTS

| | | | |
|---|---|---|---|
| 7,325,617 | B2 | 2/2008 | Murray |
| 7,395,856 | B2 | 7/2008 | Murray |
| 7,552,779 | B2 | 6/2009 | Murray |
| 8,662,162 | B2 | 3/2014 | Kellner et al. |

(Continued)

FOREIGN PATENT DOCUMENTS

WO 2008119931 A1 10/2008

OTHER PUBLICATIONS http://advancedupstream.com/limitless-frac-system/ 12 pages, retrieved from the internet Mar. 10, 2021.

(Continued)

*Primary Examiner* — Catherine Loikith
(74) *Attorney, Agent, or Firm* — Cantor Colburn LLP

(57) ABSTRACT

A multi-stage object drop frac assembly that includes a fracture subassembly is configured for disposal in a well zone. The assembly includes a plurality of filtration media stages configured for disposal in the same well zone. A plurality of valves, one of the plurality of valves being associated with each of the plurality of filtration media stages is a part of the assembly and the plurality of valves are openable simultaneously in response to the same event.

19 Claims, 10 Drawing Sheets

(56) References Cited

U.S. PATENT DOCUMENTS

| | | | | |
|---|---|---|---|---|
| 9,404,340 | B2 * | 8/2016 | Wood | E21B 47/13 |
| 10,030,474 | B2 * | 7/2018 | Themig | E21B 43/26 |
| 10,358,892 | B2 | 7/2019 | Wakefield et al. | |
| 10,619,436 | B2 | 4/2020 | Stone et al. | |
| 2009/0084553 | A1 | 4/2009 | Rytlewski et al. | |
| 2012/0305265 | A1 | 12/2012 | Garcia et al. | |
| 2014/0246207 | A1 | 9/2014 | Hofman et al. | |
| 2017/0067314 | A1 | 3/2017 | Flores Perez et al. | |
| 2019/0136665 | A1 | 5/2019 | Themig et al. | |

OTHER PUBLICATIONS

InfinityFracX: Dissolvable Dart Activated Sliding Sleeve Stimulation System; Sigma Energy Services; 2017; 2 pages.

Notification of Transmittal of the International Search Report and the Written Opinion of the International Searching Authority, or the Declaration; PCT/US2022/019425; dated Jun. 21, 2022; 12 pages.

WellBoss "Smart Dart—Large Bore Completion System"; Technical Brochure; 2 pages.

* cited by examiner

MULTI-STAGE OBJECT DROP FRAC ASSEMBLY WITH FILTRATION MEDIA AND METHOD

BACKGROUND

In the resource recovery and fluid sequestration industries, the use of fracturing has become nearly indispensable in many cases. In all cases though, fracturing comes with added time and expense for construction or treatment of a well system and usually results in several runs with different tool strings to achieve the desired result without having one operation damage components run for a different operation. In some situations, production of sand and proppant from the formation is deleterious to the operations and a means to filter that sand and proppant in the production flow after the fracturing operation is desirable. Efficiency is paramount and accordingly, the art is always receptive to assemblies and methods that accomplish desired results while reducing number of runs or cost.

SUMMARY

An embodiment of a multi-stage object drop frac assembly including a fracture subassembly configured for disposal in a well zone, a plurality of filtration media stages configured for disposal in the same well zone, and a plurality of valves, one of the plurality of valves being associated with each of the plurality of filtration media stages the plurality of valves openable simultaneously in response to a same event.

An embodiment of a filtration media stage for a fracturing assembly including a filtration media sub having a port extending radially therethrough, a filtration media disposed to filter fluid passing through the port, a valve disposed to open or close the port, the valve when closed protecting the filtration media from pressure internal to the filtration media sub, and an indexing mechanism configured and positioned to dictate valve movement in response to internal housing pressure.

An embodiment of a method for fracturing a zone in a wellbore including dropping a first object on a fracture subassembly, dropping a second object on each landing feature of a plurality of valves having landing features, shifting each seat of the plurality of valves with the same second object, closing the fracture subassembly with the same second object, pressuring up against the second object to cycle individual indexing mechanisms in each of the plurality of valves, opening the plurality of valves in response to the indexing mechanism reaching a preselected condition.

BRIEF DESCRIPTION OF THE DRAWINGS

The following descriptions should not be considered limiting in any way. With reference to the accompanying drawings, like elements are numbered alike.

7*a* is cross-section view of an alternate embodiment of the valve disclosed herein that protects production screens during fracturing in a first condition

Figure 8:
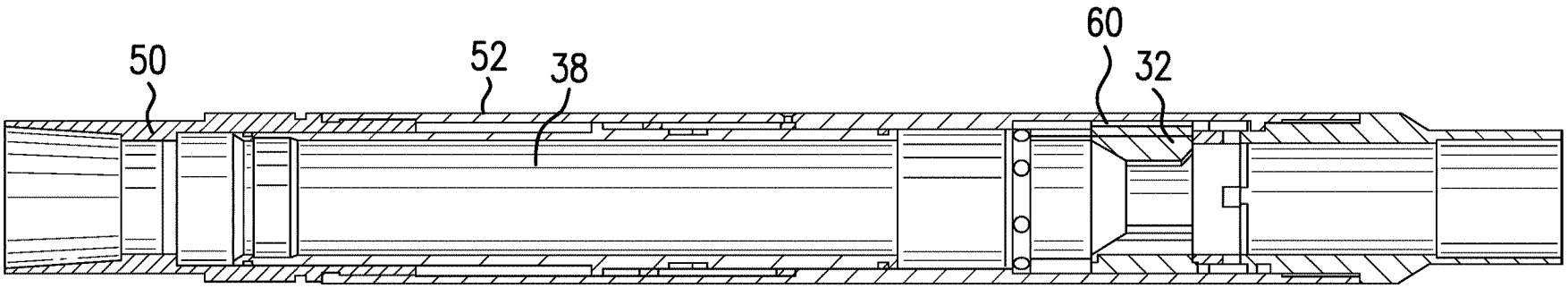
Figure 9:
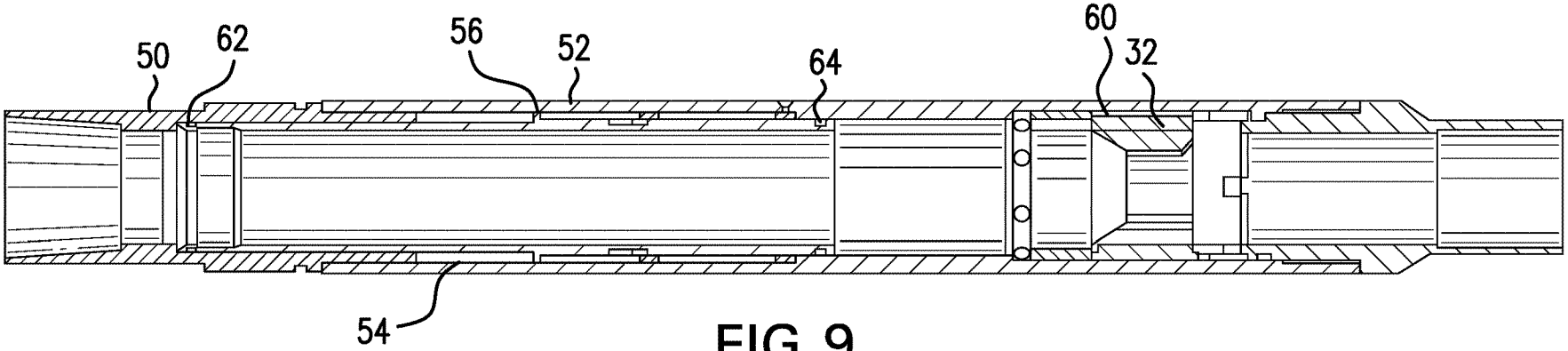
Figure 10:
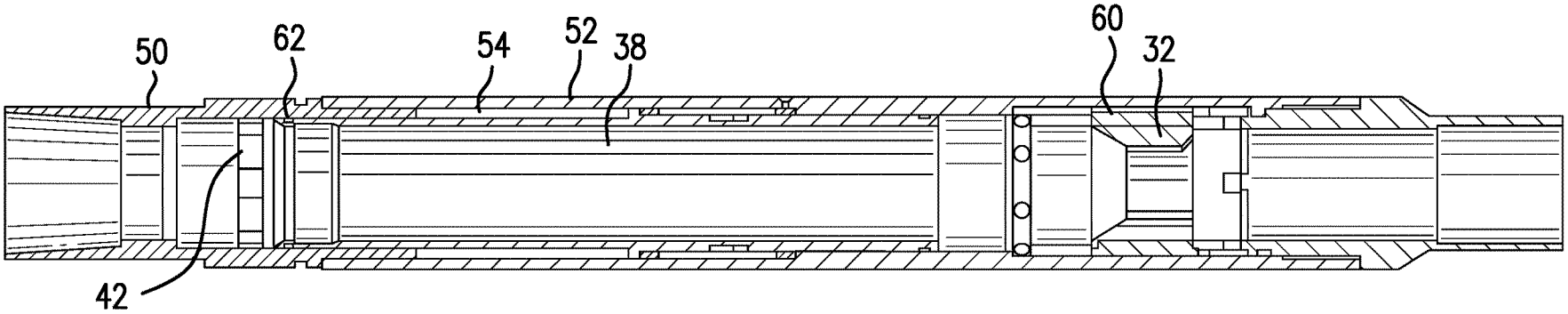
Figure 15:
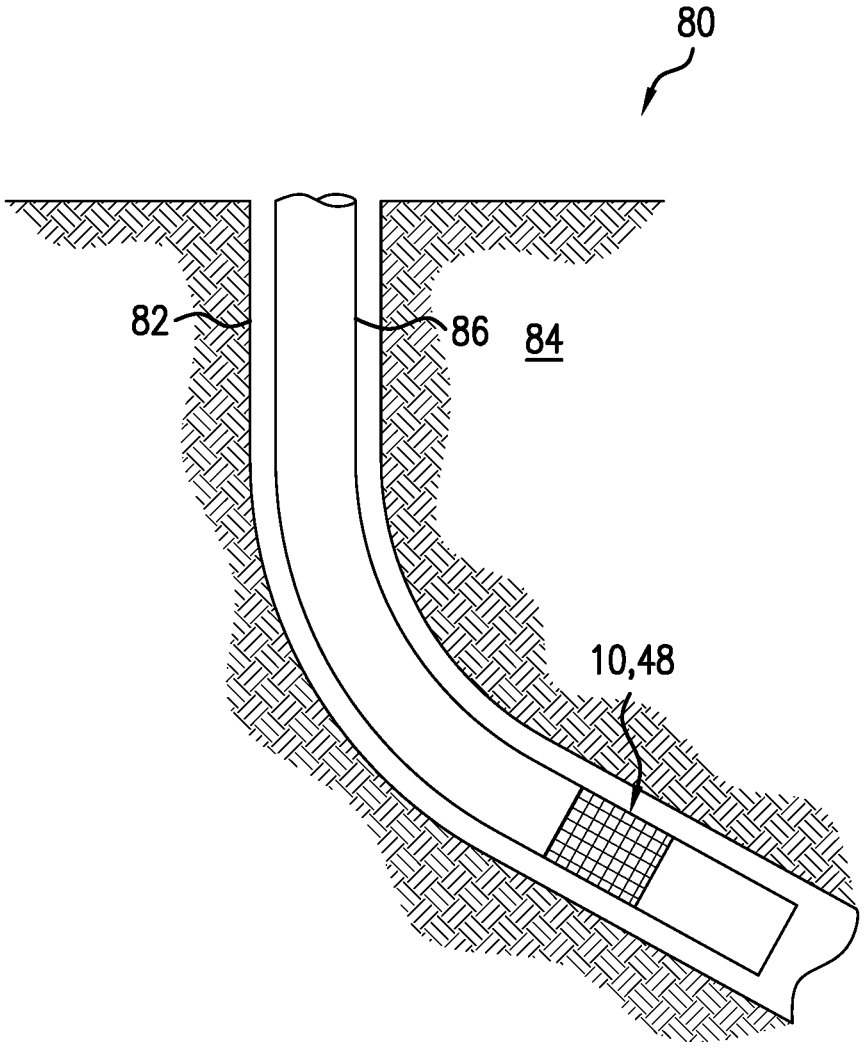

7*b* is cross-section view of another alternate embodiment of the valve disclosed herein that protects production screens during fracturing in a first condition FIG. 8 is cross-section view of the valve disclosed herein that protects production screens during fracturing in a second condition;

FIG. 9 is cross-section view of the valve disclosed herein that protects production screens during fracturing in a third condition;

FIG. 10 is cross-section view of the valve disclosed herein that protects production screens during fracturing in a fourth condition;

FIGS. 11-14 are the valve in the same conditions as FIGS. 7-10 respectively but have aa housing removed to improve understanding of the mechanism of the valve; and FIG. 15 is a schematic illustration of a wellbore system including the filtration media stage and/or multi-stage object drop frac assembly with filtration media as disclosed herein.

DETAILED DESCRIPTION

A detailed description of one or more embodiments of the disclosed apparatus and method are presented herein by way of exemplification and not limitation with reference to the Figures.

Figure 1:
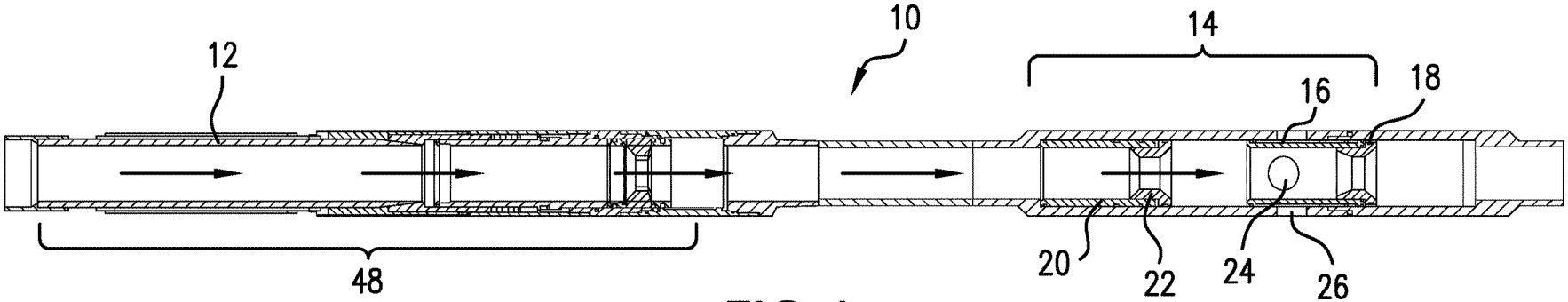
FIG. 1 is a cross-section view of a multi-stage object drop frac assembly with filtration media as disclosed herein in an RIH in condition.
Figure 2:
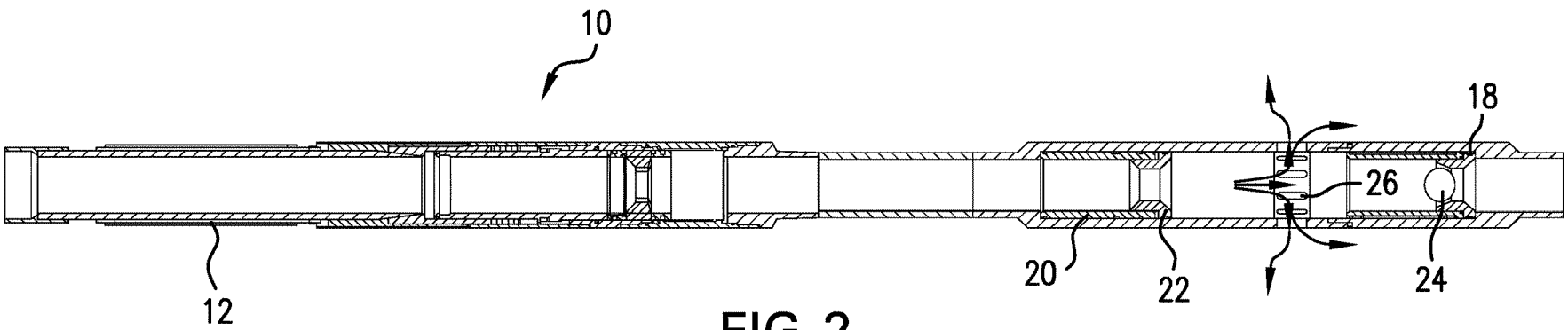
FIG. 2 is cross-section view of the assembly in a fracture condition.

Referring to FIGS. 1 and 2, a cross-section view of a multi-stage object drop frac assembly 10 with filtration media 12 such as sand control screens is illustrated. The assembly 10 includes a fracture subassembly 14 having an opening sleeve 16 with first landing feature that is illustrated as a first size seat 18 and a closing sleeve 20 with a second landing feature that is illustrated as a second size seat 22. A "landing feature" as used herein may be a seat, a selective profile, a feature that works with a counting dart, etc. providing that the object can both anchor there and provide a sealing function (i.e. sufficiently sealed that a pressure differential across that engaged object may be generated that has a desired effect). It is to be appreciated that throughout this application "seats" are primarily discussed but the other landing features may be substituted and are contemplated. A first size object (mutatis mutandis for selective profile or counting dart, for example) 24 landed on the seat 18 will open the sleeve 16 thereby exposing fracture ports 26. This is visible in FIG. 2. For purposes of this disclosure an "object" may be a ball, dart, or other droppable object having a shape of a sphere, cone, frustocone, ogive, or other profile including a selective profile and further including a counting dart, that is configured to land on and/or seal against a landing feature such as a seat or profile. It is also noted that such object might also have a profile thereon that both physically engages a complementary profile on the seat and also seals therewith or otherwise provides a seal. It is to be appreciated that in the primarily illustrated embodiment the first size object lands on nothing uphole of the seat 18 because it is too small to land on seats in that location (or in other embodiments, because selective profiles don't find their complements in those locations or counting darts have not reached their target count). Accordingly, the object 24 will flow directly to seat 18, land there and upon application of pressure from surface, shift sleeve 16 to open the frac ports 26. With the frac ports 26 open, pressure from surface is applied and will fracture the formation through the ports 26. While more description below will educate on how, it is notable at this point that componentry uphole of the fracture ports 26 are not affected by the pressure event including screens uphole since all pressure pathways are closed to the pressure event internal to the assembly at this point. Not only are screens protected this way but losses of pressure through screens that would otherwise be opened by a second object 30 is prevented. When the operator is trying to close the closing sleeve 20 with the second size object 30 on the second size seat 22, a threshold pressure is needed to overcome a holding configuration such as shear screws (not shown). If the pressure applied is being reduced due to leaking off through the open screens, much higher pressures are required. When using the assembly 10 as described herein this issue is avoided.

Figure 3:
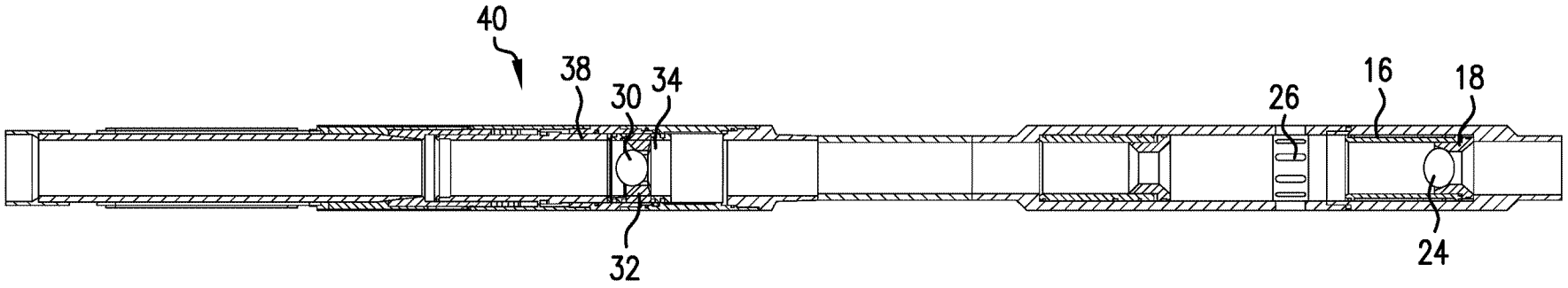
FIG. 3 is cross-section view of the assembly in an arming condition.
Figure 4:
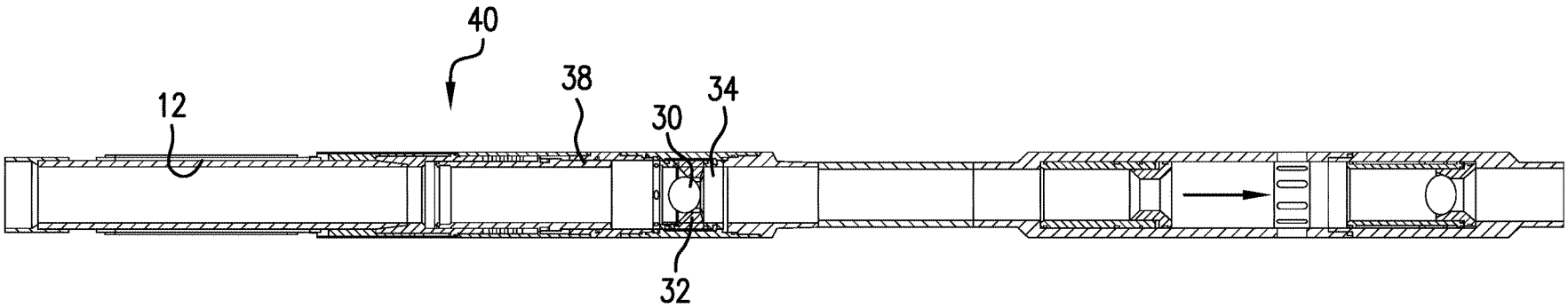
FIG. 4 is cross-section view of the assembly in an armed condition.
Figure 5:
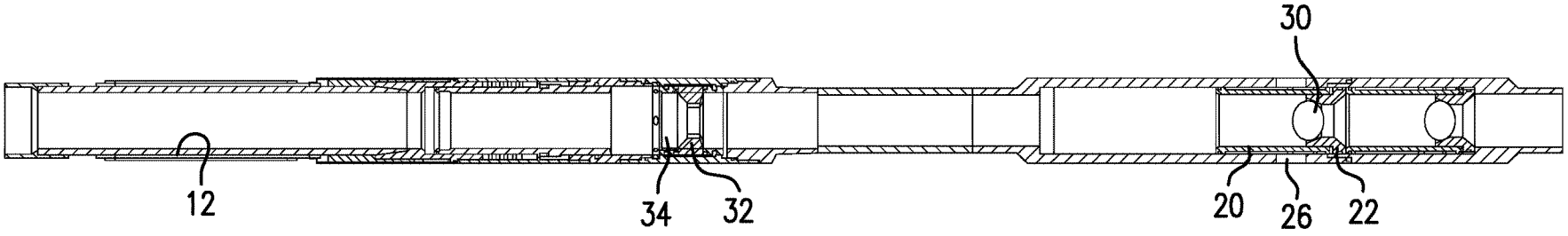
FIG. 5 is cross-section view of the assembly in a frac subassembly closed condition.
Figure 6:
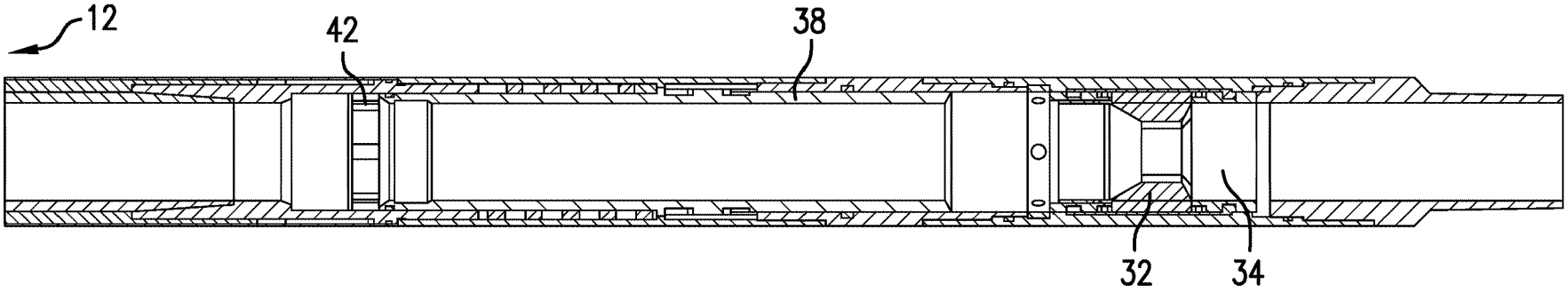
FIG. 6 is cross-section view of the assembly in a production port open condition.

Referring to FIGS. 3-5, the second size object 30, larger than the first size object 24 is dropped into the assembly 10. The second size object 30 is specifically sized to land upon a plurality of seats 32 (one shown) each of which is disposed in a cage 34 and is configured to pass the second size object 30 under selected circumstance. The circumstance for allowing the object 30 to pass is a pressure event that exceeds the retaining power of a release configuration 36. The release configuration 36 (numbered here but not visible except in FIGS. 11-14) may comprise a shear screw, or a C-ring, etc. or may comprise a collet, wherein the shear screw or other failure defeatable member is a one-time operable component and the collet allows for multiple operations with appropriate resetting actions taken. In either case, upon a pressure up event from surface against the second object 3C) in the seat 32 results in the cage 34 being moved such that the cage 34 no longer locks a closure member 38 of a valve 40 from moving. In one embodiment this is accomplished by the cage 34 being separated from the closure member 38 (a sleeve in this embodiment) as illustrated in the different conditions of FIG. 3 and FIG. 4. In the condition of FIG. 4, the valve 40 is "armed" in that it is now unlocked and capable of responding to pressure events internal to the assembly 10. Also to be appreciated in the condition of FIG. 4 is that the cage 34 has moved to a position where the seat 32 is not radially outwardly supported. Hence the seat 32 may move radially outwardly thereby allowing the second object 30 to pass therethrough. FIG. 5 shows the second object 30 having passed through the seat 32 and landed upon the seat 22 resulting in the closure of the sleeve fracture subassembly 14. It is reiterated that although only one valve 40 is illustrated herein, a plurality of such valves and a plurality of screens 12 are contemplated, each valve being responsive to the same second size object and behaving as did the one just described. Subsequent to the second size object completing its journey to the seat 22 and closing the sleeve 20, each of the plurality of valves 40 will be in the "armed" condition and responsive to pressure events inside the assembly 10. This is not to say that the screens 12 will experience the pressure events. Rather the screens 12 are protected from the pressure events by the closure members 38 of the valves 40 being in the closed position while the pressure events occur. Specifically how the closure members 38 come to be in a position that allows fluid communication from the inside of the assembly 10 to the screens 12 will be described hereunder but for completeness of the illustration of how the assembly 10 operates, FIG. 6 shows a condition where ports 42 are open after the closure member 38 has been shifted to a position allowing fluid communication from inside the assembly 10 to the screens 12 through the ports 42. In some embodiments, ports 42 may be production ports.

Referring to FIGS. 7-14, cross section views of a portion of one of a plurality of filtration media stages 48 (only one is shown but a plurality is contemplated and achieved simply by replication of the one stage 48 shown) of the multi-stage object drop frac assembly 10 that focus on valve 40 are enlarged for a better view. Illustrated in these figures is filtration media sub 50, which is connected to a valve housing 52 within which is the closure member 38 that is hiding ports 42 (in FIGS. 7-9 and 11-13), The filtration media 12, discussed above, is not visible on these Figures but is mounted on the filtration media sub 50 and would be located to the left of the drawing sheets for FIGS. 7-14. Over FIGS. 7-10, attention should be paid to the position of closure member 38, seat 32 and cage 34. It is also important to be aware that a biasing member 54 is disposed between filtration media sub 50 and the closure member 38. The biasing member 54 is a compression member that is configured to urge a flange 56 of closure member 38 away from shoulder 58 of filtration media sub 50. In some embodiments, the biasing member may be a coil spring. In the condition of the stage 48 shown in FIG. 7, the closure member 38 is held in its most uphole position (left of Figure) by the cage 34, which is held in place by the release configuration 36 for RIFT (run in hole). For clarity of disclosure, drawing FIGS. 7*a* and 7*b* are similar to FIG. 7 but substitute a selective profile in 7*a* and a counting dart in 7*b* for the seat shown in FIG. 7. The selective profile embodiment includes an object that bypasses non-complementary landing features and locates only on a complementary feature. The counting dart illustrated in FIG. 7*b* counts some feature of the string as it passes, be that a physical feature, magnetic feature, RFID, etc. and does not engage a landing feature until the count reaches the required number. Each of these technologies is known to the art in broad form and hence require no specific teaching here. They are however novel in combination with the other features of the present disclosure. As described above, each of these is part of a set of structures collectively referenced by the term landing feature).

Figure 7:
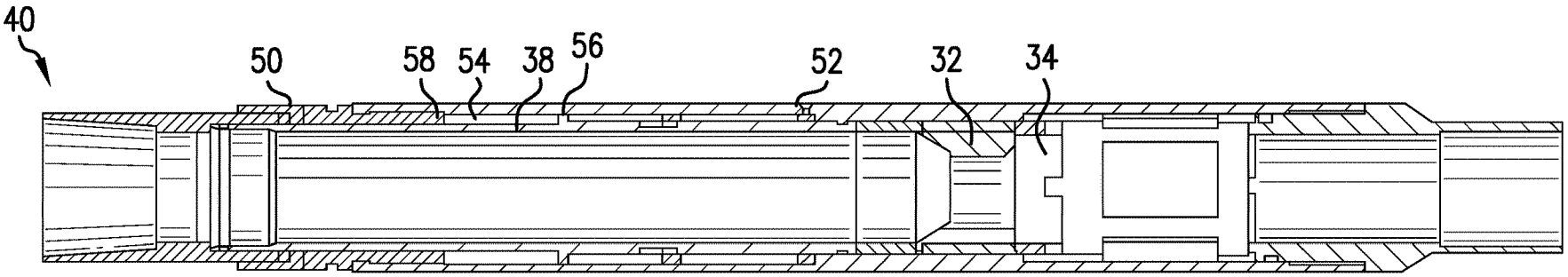
FIG. 7 is cross-section view of the valve disclosed herein that protects production screens during fracturing in a first condition.
Figure 7A:
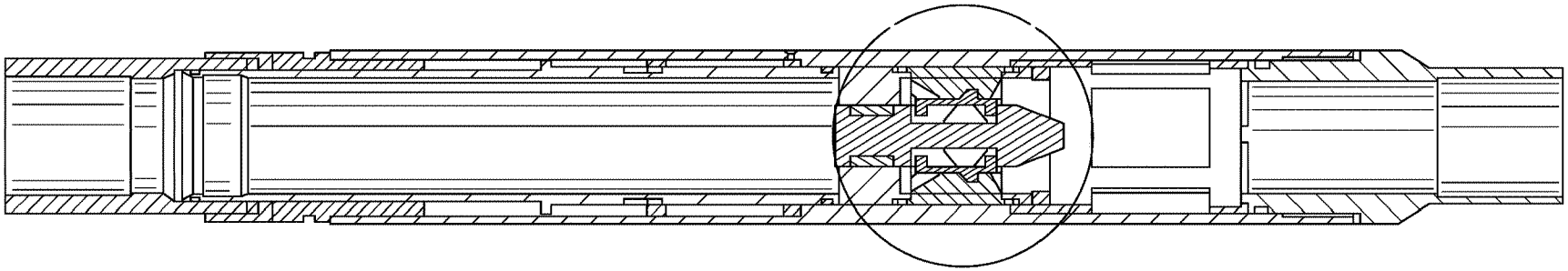
Figure 7B:
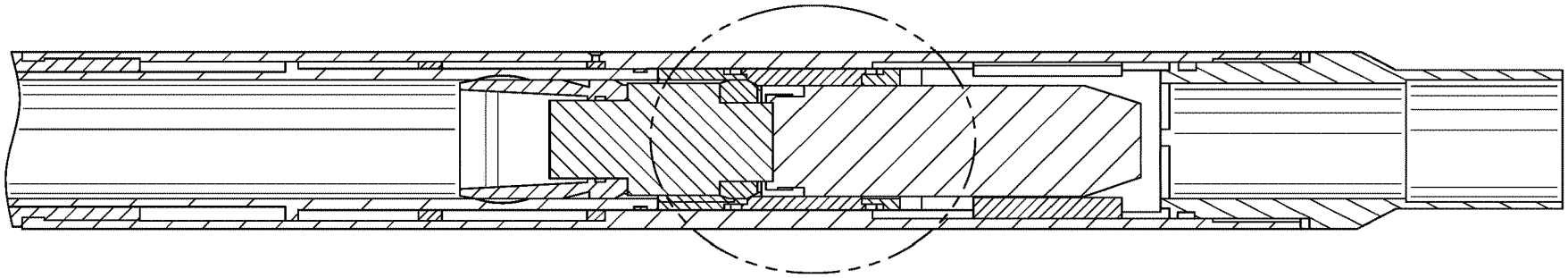

As described above, the stage 48 will retain this position shown in FIG. 7 while allowing the first size object 24 to pass since it is too small to land on any of the seats 32 (or does not engage a landing feature for reasons related to the other embodiments disclosed herein). Upon the second size object 30 entering assembly 10 however, the object lands on seat 32 and pressure applied thereagainst leads to releasing the release configuration 36 and travel of the cage 34 along with seat 32 (and the second object 30 not shown in this view) downhole (right of Figure). The closure member 38 also moves some distance downhole under the impetus of biasing member 54. This is seen in FIG. 8. To be additionally appreciated in FIG. 8 is that within housing 52, there is an undercut 60. When the seat 32 moves downhole, the undercut becomes radially outwardly positioned of the seat 32 and allows the seat 32 to grow in size. This may be because the seat is segmented or may be because it is deformable, for example. The result in either embodiment is the aforementioned passage of the second size object through the seat 32 at this point. The position of the closure member 38 illustrated in FIG. 9 is due to a pressure event inside of the assembly 10. This would be against the second object 30, which is at this point sitting in the second seat 22 and having closed the sleeve 20 of the fracture subassembly 14. The pressure acts on two seals 62 and 64 of the closure member 38. Seal 62 rides within filtration media sub 50 and seal 64 rides within housing 52. Seal 62 is of a smaller area than seal 64 and hence greater pressure internal to the assembly 10 than outside of the assembly 10 will cause member 38 to move leftwardly of the Figure due to the different areas. The larger area will develop more force. This force counteracts the bias of the biasing member 54 in order to move the closure member 38 to the position in FIG. 9. Upon the release of the pressure causing the closure member 38 to attain the position of FIG. 9, the closure member will under the urging of biasing member 54, attain the position illustrated in FIG. 10, thereby uncovering the ports 42. Uncovering ports 42 allows fluid continuity between an inside of the assembly 10 and the filtration media 12 to the outside of the assembly 10. It is noted that if pressure outside of the assembly 10, i.e. formation pressure is always higher than hydrostatic pressure inside of the assembly 10, then the biasing member may be omitted since its function would be substituted by formation pressure acting on the seals 62 and 64 when pressure inside the assembly 10 is not artificially increased by pressure application from surface.

Figure 12:
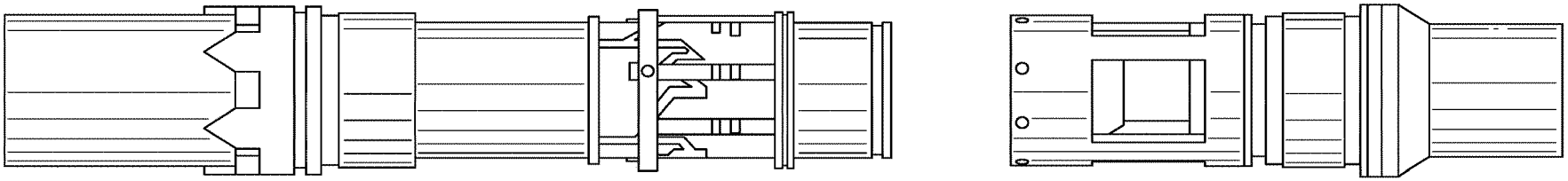
Figure 13:
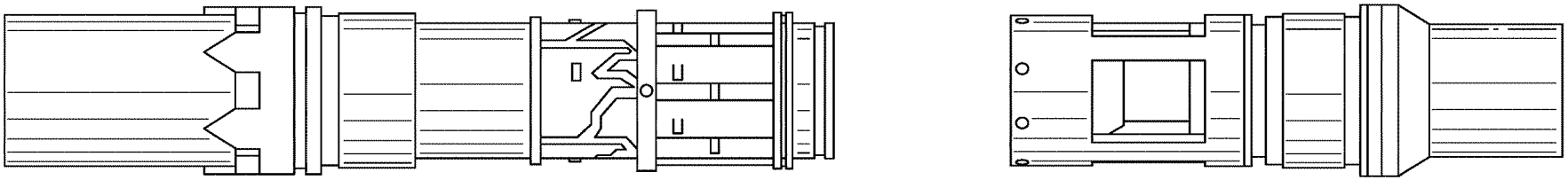
Figure 14:
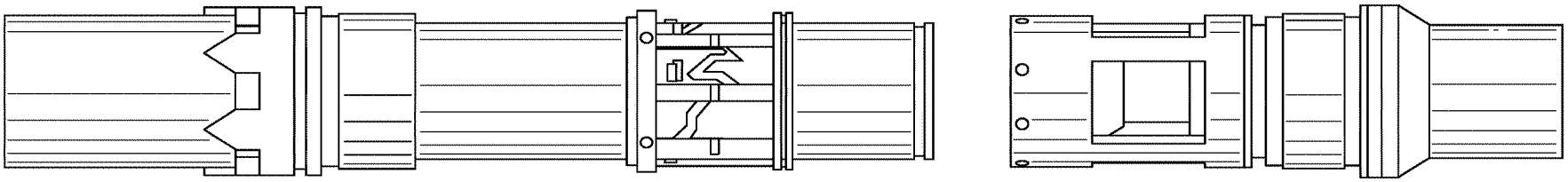

Turning now to how the closure member takes the actions noted above reference is made to FIGS. 11-14. As stated above, FIGS. 11-14 are in the same positions as FIGS. 7-10 but the housing 52 has been rendered transparent to provide greater understanding. It will now be evident that the closure member 38 includes on an outside surface 63 thereof, an indexing mechanism 65 that is in this embodiment in the form of a I-Slot. The release configuration 36 is also visible in these views and is in this embodiment in the form of a collet. The collet 36 functions to support a J-slot follower 72 and to provide resetability to the assembly 10 by using a profile 68 thereon that interacts in certain rotational orientations with nubs 70 on surface 63 of closure member 38. It can be seen in the transition of FIGS. 11 to 12 that the follower 72 causes rotation of the collet 36 while the closure member 38 is moving downhole under the impetus of biasing member 54. In FIG. 12, the rotation has aligned the profile 68 and the nub 70. In order for a pressure event inside of the assembly 10 to cycle the closure member to the left of the figure as shown in FIG. 13, the pressure must be able to create sufficient force through seals 62 and 64 to overcome the collet 36 by forcing the profile 68 to deflect over the nub 70. Once the closure member 38 is pressure driven to the position in FIG. 13, the J-slot follower 72 is in a position of the i-slot that allows full movement of the closure member 38 to the open position. Bleed down of pressure inside of assembly 10 with the J-slot in this position allows the biasing member 54 to open ports 42 by pushing the closure member 38 in the downhole direction (right of the figure). Stated alternately, when the J-Slot is in the position illustrated in FIG. 13, the closure member 38 will open at bleed down of pressure.

Figure 11:
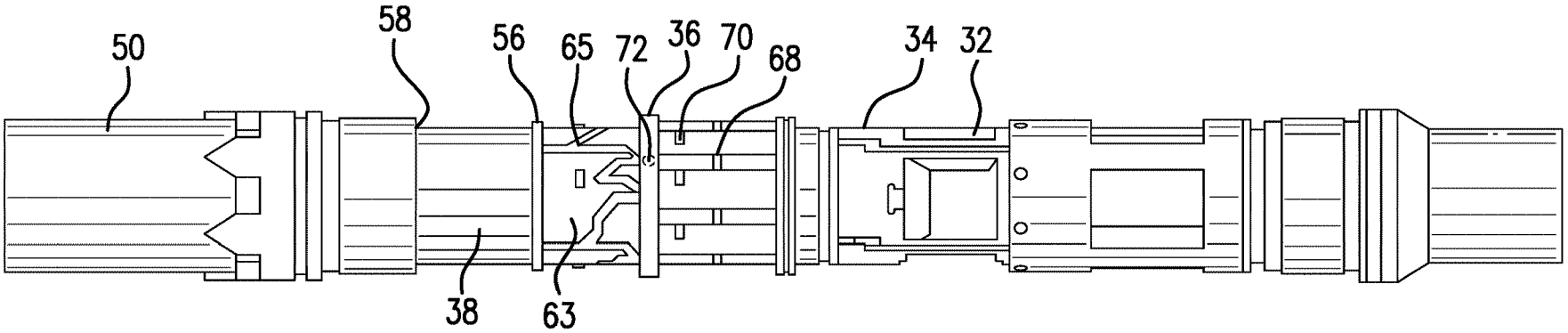

The filtration media stage 48 may be reset by shifting the closure member 38, by for example a shifting tool, to the position illustrated in FIGS. 7 and 11. Once shifted by the shifting tool, the stage 48 may be reopened by running through the sequence discussed above or may be reopened using the shifting tool. If the shifting tool is used to reopen the stage 48, the closure member 38 will be pulled uphole (leftwardly of the Figure) from the armed position and then released. Upon release, the closure member 38 will be moved by the biasing member 54 to the open position.

Referring to FIG. 15, a wellbore system 80 is illustrated. The system 80 includes a borehole 82 disposed in a subsurface formation 84. A string 86 is disposed in the borehole 82 and a filtration media stage 48 and/or an entire an assembly 10 as described herein is disposed with the string 86.

Set forth below are some embodiments of the foregoing disclosure:

Embodiment 1: A multi-stage object drop frac assembly including a fracture subassembly configured for disposal in a well zone, a plurality of filtration media stages configured for disposal in the same well zone, and a plurality of valves, one of the plurality of valves being associated with each of the plurality of filtration media stages the plurality of valves openable simultaneously in response to a same event.

Embodiment 2: A multi-stage object drop frac assembly as in any prior embodiment wherein the fracture subassembly includes a fracture valve openable via object on landing feature and closable.

Embodiment 3: A multi-stage object drop frac assembly as in any prior embodiment wherein the fracture valve is closable by a second object on landing feature.

Embodiment 4: A multi-stage object drop frac assembly as in any prior embodiment wherein the plurality of filtration media stages are isolated from hydraulic pressure internal to the assembly by the plurality of valves.

Embodiment 5: A multi-stage object drop frac assembly as in any prior embodiment wherein the plurality of valves include biasing members.

Embodiment 6: A multi-stage object drop frac assembly as in any prior embodiment wherein the biasing members bias the plurality of valves to open positions.

Embodiment 7: A multi-stage object drop frac assembly as in any prior embodiment wherein the plurality of valves each include an indexing mechanism.

Embodiment 8: A multi-stage object drop frac assembly as in any prior embodiment wherein each of the plurality of valves include a cage and collapsible landing feature, each cage and collapsible landing feature being movable from a position that inhibits movement of each of the plurality of valves to a position allowing movement of each of the plurality of valves, by a same object landed on each landing feature.

Embodiment 9: A multi-stage object drop frac assembly as in any prior embodiment wherein an indexing mechanism associated with each of the plurality of valves is operable only after the cage and landing feature are moved from each of the plurality of valves.

Embodiment 10: A multi-stage object drop frac assembly as in any prior embodiment wherein the plurality of valves are responsive to assembly internal pressure after the cage and landing feature are moved from each of the plurality of valves.

Embodiment 11: A multi-stage object drop frac assembly as in any prior embodiment wherein the assembly internal pressure causes movement of the indexing mechanism for each of the plurality of valves.

Embodiment 12: A multi-stage object drop frac assembly as in any prior embodiment wherein after one of the movements of the indexing mechanisms, the valves open upon reduced pressure internal to the assembly under the impetus of a biasing member associated with each valve of the plurality of valves.

Embodiment 13: A multi-stage object drop frac assembly as in any prior embodiment wherein each of the plurality of valves is resettable by a shifting tool.

Embodiment 14: A filtration media stage for a fracturing assembly including a filtration media sub having a port extending radially therethrough, a filtration media disposed to filter fluid passing through the port, a valve disposed to open or close the port, the valve when closed protecting the filtration media from pressure internal to the filtration media sub, and an indexing mechanism configured and positioned to dictate valve movement in response to internal housing pressure.

Embodiment 15: A filtration media stage for a fracturing assembly as in any prior embodiment further including a lock preventing movement of the valve.

Embodiment 16: A filtration media stage for a fracturing assembly as in any prior embodiment wherein the lock includes a cage and collapsible landing feature.

Embodiment 17: A filtration media stage for a fracturing assembly as in any prior embodiment further including a biasing member configured to open the valve when an indexing mechanism is indexed to a position that allows the opening of the valve.

Embodiment 18: A method for fracturing a zone in a wellbore including dropping a first object on a fracture subassembly, dropping a second object on each landing feature of a plurality of valves having landing features, shifting each seat of the plurality of valves with the same second object, closing the fracture subassembly with the same second object, pressuring up against the second object to cycle individual indexing mechanisms in each of the plurality of valves, and opening the plurality of valves in response to the indexing mechanism reaching a preselected condition.

Embodiment 19: A method for fracturing a zone in a wellbore as in any prior embodiment wherein the opening is upon pressure decrease of the pressure event.

Embodiment 20: A filtration media stage for a fracturing assembly as in any prior embodiment further including resetting the plurality of valves with a shifting tool.

Embodiment 21: A wellbore system including a borehole in a subsurface formation, a string in the borehole, and a multi-stage object drop frac assemble as in any prior embodiment disposed with the string.

Embodiment 22: A wellbore system including a borehole in a subsurface formation, a string in the borehole, and a filtration media stage for a fracturing assembly as in any prior embodiment disposed with the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A filtration media stage for a fracturing assembly comprising:

a filtration media sub having a port extending radially therethrough;

a filtration media disposed to filter fluid passing through the port;

a valve disposed to open or close the port, the valve when closed protecting the filtration media from pressure internal to the filtration media sub;

an indexing mechanism configured and positioned to dictate valve movement in response to internal housing pressure; and further including a lock with a cage and a collapsible landing feature preventing movement of the valve.

2. The assembly as claimed in claim 1 further including a biasing member configured to open the valve when the indexing mechanism is indexed to a position that allows the opening of the valve.

3. The assembly as claimed in claim 1 further including resetting the plurality of valves with a shifting tool.

4. A multi-stage object drop frac assembly comprising:

a fracture subassembly configured for disposal in a well zone;

a plurality of filtration media stages configured for disposal in the same well zone;

a plurality of valves, one of the plurality of valves being associated with each of the plurality of filtration media stages, the plurality of valves openable simultaneously in response to a same event; and wherein each of the plurality of valves includes a cage and collapsible landing feature, each cage and collapsible landing feature being movable from a position that inhibits movement of each of the plurality of valves to a position allowing movement of each of the plurality of valves, by a same object landed on each landing feature.

5. The assembly as claimed in claim 4 wherein the fracture subassembly includes a fracture valve openable via an object landing on a landing feature and closable.

6. The assembly as claimed in claim 5 wherein the fracture valve is closable by a second object via the landing feature.

7. The assembly as claimed in claim 4 wherein the plurality of filtration media stages are isolated from hydraulic pressure internal to the assembly by the plurality of valves.

8. The assembly as claimed in claim 4 wherein the plurality of valves include biasing members.

9. The assembly as claimed in claim 8 wherein the biasing members bias the plurality of valves to open positions.

10. The assembly as claimed in claim 4 wherein the plurality of valves each include an indexing mechanism.

11. The assembly as claimed in claim 4 wherein an indexing mechanism associated with each of the plurality of valves is operable only after the cage and landing feature are moved from each of the plurality of valves.

12. The assembly as claimed in claim 4 wherein the plurality of valves are responsive to assembly internal pressure after the cage and landing feature are moved from each of the plurality of valves.

13. The assembly as claimed in claim 12 wherein the assembly internal pressure causes movement of the indexing mechanism for each of the plurality of valves.

14. The assembly as claimed in claim 13 wherein after one of the movements of the indexing mechanisms, the valves open upon reduced pressure internal to the assembly under an impetus of a biasing member associated with each valve of the plurality of valves.

15. The assembly as claimed in claim 4 wherein each of the plurality of valves is resettable by a shifting tool.

16. A method for fracturing a zone in a wellbore comprising:

dropping a first object on a fracture subassembly;

dropping a second object on each landing feature of a plurality of valves having landing features, each landing feature comprising a cage and a collapsible seat;

shifting each seat of the plurality of valves with the same second object;

collapsing each of the collapsible seat of each landing feature;

closing the fracture subassembly with the same second object;

pressuring up against the second object to cycle individual indexing mechanisms in each of the plurality of valves; and opening the plurality of valves in response to the indexing mechanism reaching a preselected condition.

17. The method as claimed in claim 16 wherein the opening is upon pressure decrease of a pressure event.

18. A wellbore system comprising:

a borehole in a subsurface formation;

a string in the borehole; and a multi-stage object drop frac assembly as claimed in claim 4 disposed with the string.

19. A wellbore system comprising:

a borehole in a subsurface formation;

a string in the borehole; and a filtration media stage for a fracturing assembly as claimed in claim 1 disposed with the string.

* * * * *